US009896238B2

(12) United States Patent
Haines

(10) Patent No.: US 9,896,238 B2
(45) Date of Patent: Feb. 20, 2018

(54) DISPENSING CONTAINER

(71) Applicant: Willis C. Haines, Weirton, WV (US)

(72) Inventor: Willis C. Haines, Weirton, WV (US)

( * ) Notice: Subject to any disclaimer, the term of this patent is extended or adjusted under 35 U.S.C. 154(b) by 45 days.

(21) Appl. No.: 15/019,115

(22) Filed: Feb. 9, 2016

(65) Prior Publication Data

US 2017/0225836 A1 Aug. 10, 2017

(51) Int. Cl.

| | |
|---|---|
| ***B65D 43/18*** | (2006.01) |
| ***B65D 25/10*** | (2006.01) |
| ***B65D 43/16*** | (2006.01) |
| ***B65D 43/22*** | (2006.01) |
| ***B65D 43/26*** | (2006.01) |
| ***B65D 51/18*** | (2006.01) |

(52) U.S. Cl.

CPC ..... *B65D 25/10* (2013.01); *B65D 43/16* (2013.01); *B65D 43/22* (2013.01); *B65D 43/26* (2013.01); *B65D 51/18* (2013.01); *B65D 2251/009* (2013.01); *B65D 2251/0021* (2013.01); *B65D 2251/0028* (2013.01)

(58) Field of Classification Search

CPC ..... B65D 25/10; B65D 51/18; B65D 43/26; B65D 43/22; B65D 43/16; B65D 2251/0028; B65D 2251/009; B65D 2251/0021

USPC .... 220/480–483, 324, 259.1, 260, 262, 263, 220/810, 836–848, 254.1–254.9, 256.1, 220/729; 222/478, 481; 206/223

See application file for complete search history.

(56) References Cited

U.S. PATENT DOCUMENTS

| | | | | |
|---|---|---|---|---|
| 3,050,182 | A | 8/1962 | Conroy | |
| 3,514,029 | A | 5/1970 | Powell | |
| 4,416,370 | A | 11/1983 | Beall | |
| 4,923,702 | A | 5/1990 | Powell et al. | |
| 5,584,388 | A | 12/1996 | Johnson | |
| 6,022,570 | A | 2/2000 | Richmond | |
| 6,082,573 | A * | 7/2000 | Hofman | A47K 3/281 220/480 |
| 6,253,669 | B1 | 7/2001 | Bourque | |
| 6,526,911 | B2 * | 3/2003 | Louden | A01K 1/0356 119/51.01 |
| 7,513,219 | B2 * | 4/2009 | Louden | A01K 1/0356 119/477 |
| 8,701,337 | B2 * | 4/2014 | Kay | A01M 25/004 206/818 |
| 9,226,619 | B2 * | 1/2016 | Constantino, Jr. | A47J 43/22 |
| 9,387,962 | B2 * | 7/2016 | Mercado | B65D 43/22 |

(Continued)

FOREIGN PATENT DOCUMENTS

EP 0 637 926 B1 12/1998

*Primary Examiner* — Kareen Thomas

(74) *Attorney, Agent, or Firm* — Maier & Maier, PLLC

(57) ABSTRACT

This invention relates to a spring-loaded compartmented container that may be used to house Non-Gluten, substantially Gluten-Free, Eucharistic Wafers, and other objects. A goal of the invention is to provide relief to individuals that wish to practice Holy Communion that may have Celiac disease or other Gluten or non-gluten allergies. The compartmented container may contain an attachment device, such as a clip, on at least a side of the container which may be used for mounting purposes, a retaining plate and spring on the interior of the container which may be used to move circular objects to a forward position, and a lid mounted to a hinge that may be activated by a depressible button with a single hand.

9 Claims, 7 Drawing Sheets

(56) References Cited

U.S. PATENT DOCUMENTS

| | | | | |
|---|---|---|---|---|
| 2005/0142272 | A1 | 6/2005 | Heschmeyer et al. | |
| 2013/0081364 | A1* | 4/2013 | Piscopo | B65B 69/00 53/492 |
| 2015/0210444 | A1* | 7/2015 | Mercado | B65D 43/22 220/212 |

* cited by examiner

DISPENSING CONTAINER

BACKGROUND

It is well understood that significant amounts of people may have allergic reactions to specific nutritional compositions. For example, persons suffering from Celiac disease may have adverse allergic reactions to nutritional compositions comprising processed wheat. Persons suffering from Celiac disease have few efficient alternatives when partaking in group activities that involve food-based products that may have wheat or other additives. For example, persons suffering from Celiac disease that wish to participate in Communion by receiving a Eucharistic Wafer may have to refrain from participation due to a food allergy. Viewed from the perspective of a Eucharistic Minister it is difficult to effectively separate non-gluten from ordinary Eucharistic Wafers such that one can administer non-gluten wafers to parishioners with food allergies in confidence.

SUMMARY

According to an exemplary embodiment, a container may be provided. The container may include a cupped body having a fixed sidewall and bottom wall. The container may further have a hinged lid. A stopper mechanism may be disposed on an interior surface of the bottom wall of the container. A retaining plate may be disposed in an opening of the cupped body of the container. The container may include a closure latch disposed on the lid and a corresponding release button disposed on the sidewall. Finally, an attachment device may be disposed on an exterior surface of the bottom wall.

According to another exemplary embodiment, a container may be provided. The container may include a cupped body having a flat bottom wall and a substantially cylindrical sidewall. The container may further include a hinged lid, which may be configured to cover an opening of the cupped body. A closure latch may be provided on the lid and a release button may be disposed in the cupped body. The closure latch and release button may act in concert to close and release the hinged lid. A stopper mechanism may be disposed on an interior bottom surface of the body and a retaining plate may be disposed in an end of the cupped body. The stopper mechanism may bias an object against the retaining plate. Finally, an attachment device may be disposed on an exterior surface of the bottom wall.

BRIEF DESCRIPTION OF THE FIGURES

Advantages of embodiments of the present invention will be apparent from the following detailed description of the exemplary embodiments. The following detailed description should be considered in conjunction with the accompanying figures in which:

Exemplary FIG. 1 may show an exemplary embodiment of a container;

Figure 2:
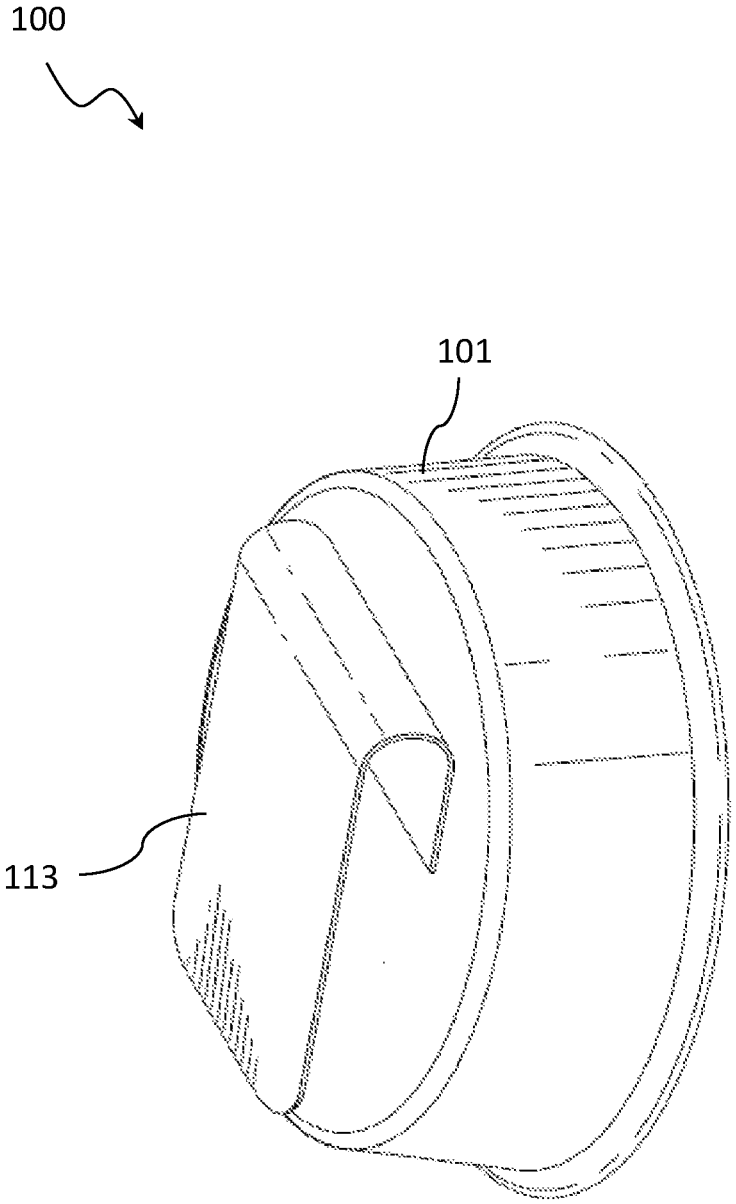
Figure 3A:
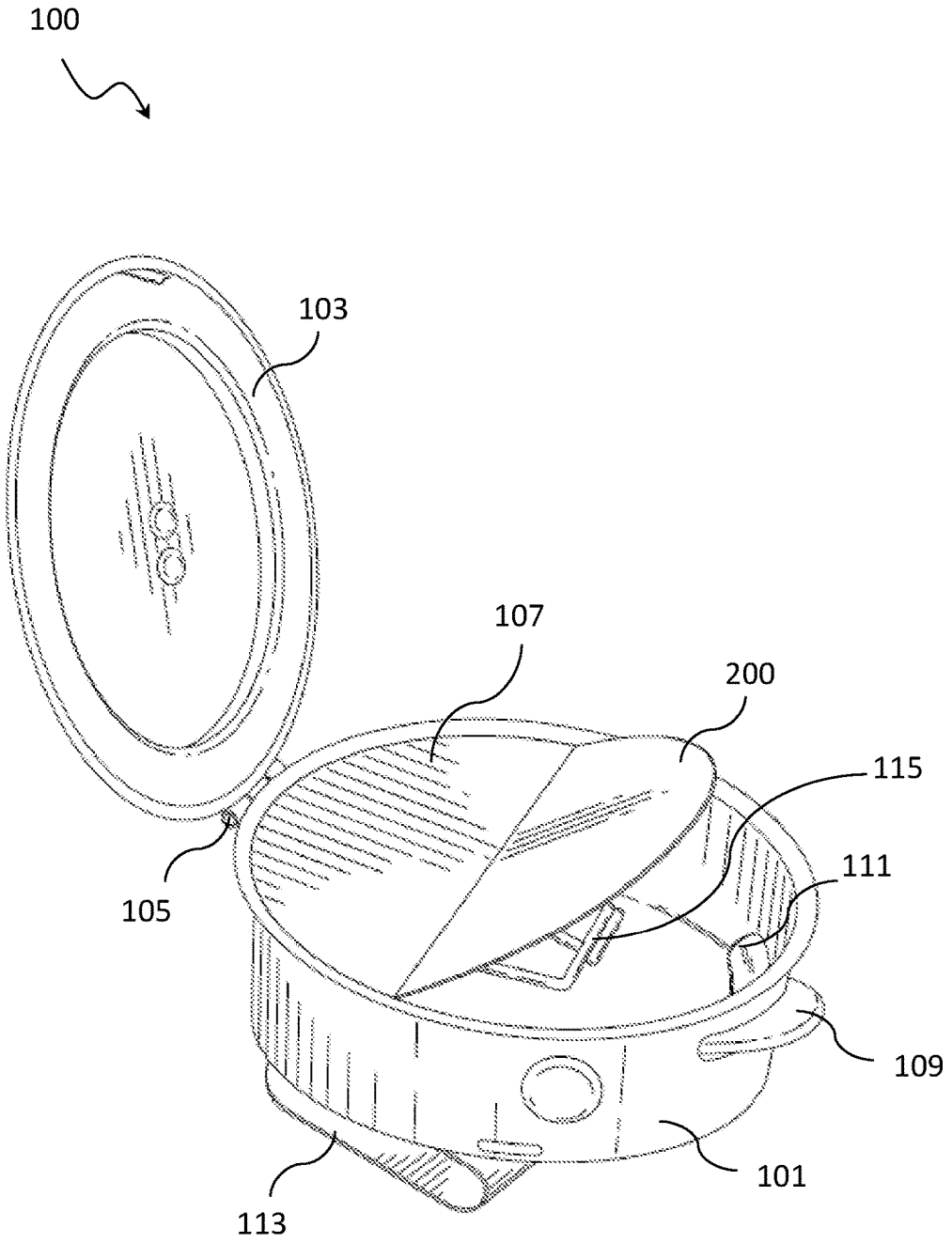
Figure 3B:
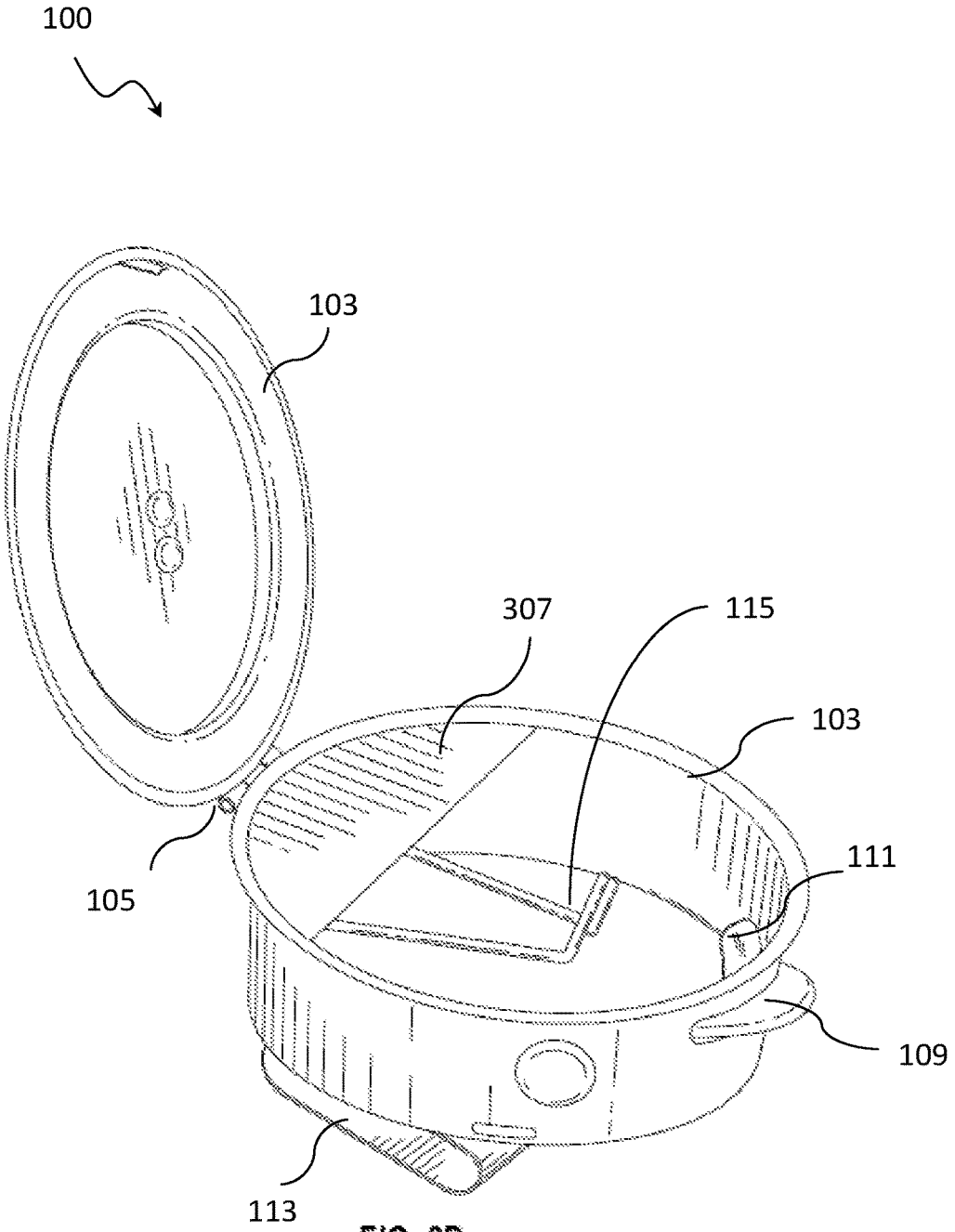
Figure 4:
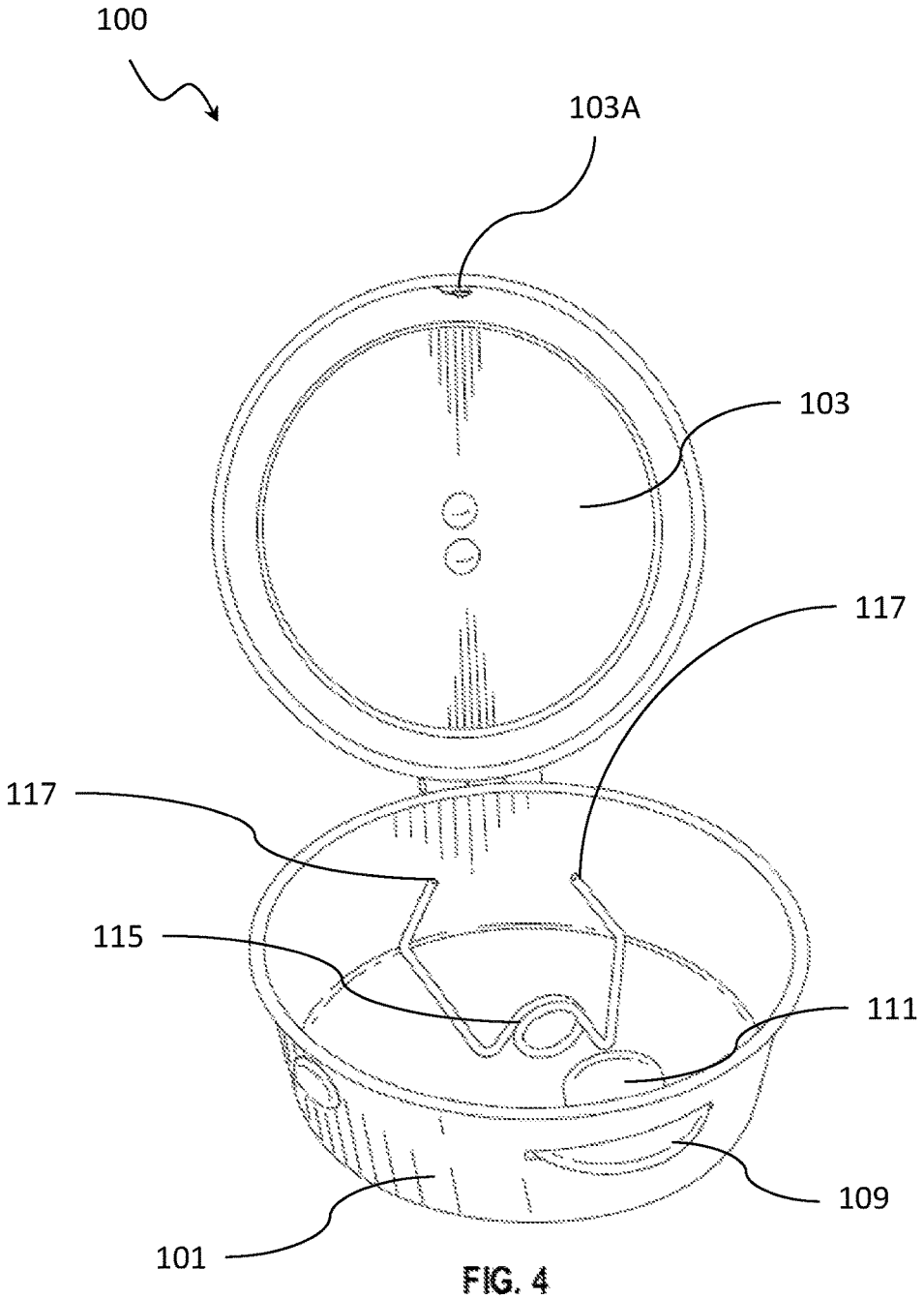
Figure 5:
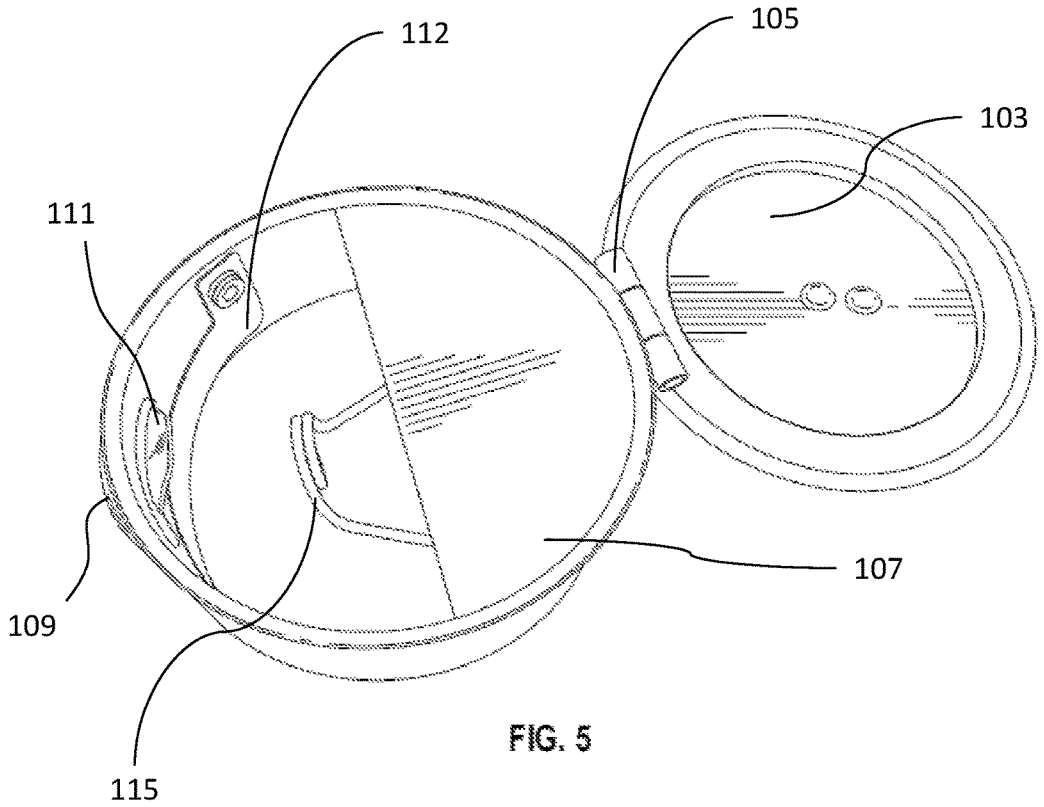
Figure 6:
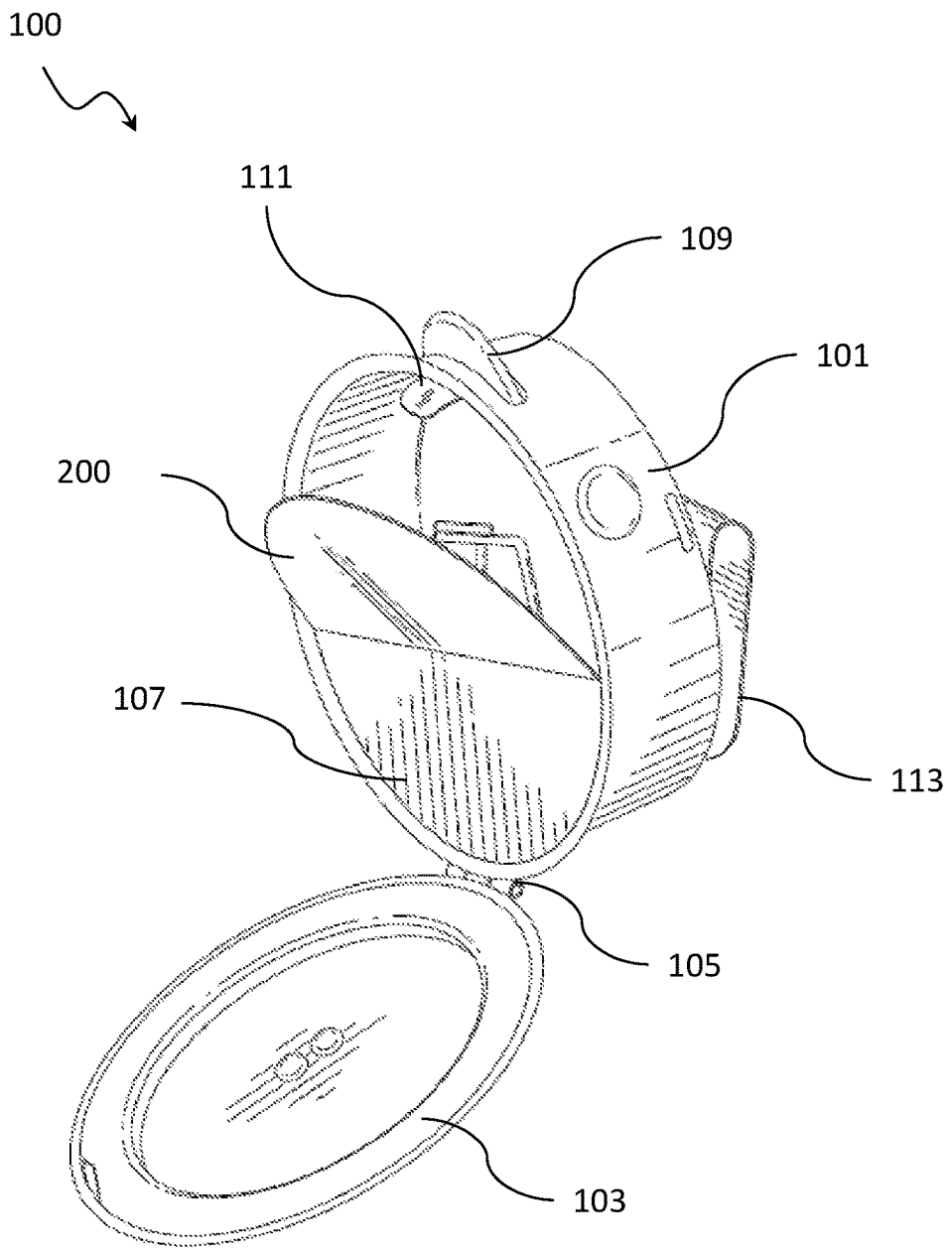

Exemplary FIG. 2 may show an exemplary embodiment of the attachment portion of a container;

Exemplary FIG. 3A may show an exemplary embodiment of a container in an open position with an exemplary food product;

Exemplary FIG. 3B may show an exemplary embodiment of a container in an open position;

Exemplary FIG. 4 may show an exemplary embodiment of a container in an open position;

Exemplary FIG. 5 may show an exemplary embodiment of a container in an open position;

Exemplary FIG. 6 may show an exemplary embodiment of a container in a position that may represent an advantageous operable position.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, a container may be provided. The container may have a body having fixed side and bottom walls, a hinged lid, and a stopper mechanism capable of angling the orientation of contents of the container. The angling of the contents may cause contents to rest against a retaining plate, as would be understood by a person having ordinary skill in the art. This may facilitate the extraction of contents. In some alternative embodiments, the stopper mechanism may be a spring or other spring like mechanism, that acts in concert with a retaining plate thereby keeping an object in a retained position flush against the retaining plate. The container may have a closure latch configured to act in concert with a release button. Additionally, the container may have an attachment device, which may be shaped like a clip. The attachment device may alternatively be magnetic such that the container may magnetically attach to other articles.

Referring to FIGS. 1-6 generally, a container 100 may be provided. The container 100 may have a body 101 with sidewalls substantially in the shape of a circle. The body may have a fixed bottom and a top or lid 103. The lid 103 may be mounted to the body 101 by a hinge 105 or other similarly situated mechanism. When used in an upright orientation, hinge 105 may allow lid 103 to open downward. The container may feature a closure latch and a release button whereby the closure latch and release button act in concert to close and release the lid. The closure latch and release button may be spring or hinge activated such that the lid of the container may be releasable in operation with a single hand. The lid 103 may remain in a closed position when a closure latch 111 engages with the underside of the lid 103. The lid 103 and hinge 105 may optionally be spring-loaded or have actuated hinges. The container may feature a release button 109 that when activated releases the closure latch 111 from an engaged position with the lid 103. The release button may be spring activated by a sprung lever arm or other similarly situated mechanism. The container may have a stopper mechanism 115 secured to the interior portion of the bottom of the body. The stopper mechanism 115 may be a fixed element and may cause contents of the container to be disposed at an angle, such that contents are inclined to lean against a retaining plate 107. In a fixed element embodiment, a stopper mechanism may be any piece of material capable of functioning as a stopper, such as a piece of metal wire, a block of material, or other elements as would be understood by a person having ordinary skill in the art. In some alternative embodiments, the interior surface of the bottom of the body may be angled, such that contents of the container are included to lean against a retaining plate 107. In some embodiments, the stopper mechanism 115 may be a sprung lever arm, a helical spring, or other similarly situated mechanism. The spring may provide a modest force sufficient to push an object 200, such as an edible wafer against a retaining plate 107.

The retaining plate 107 may be attached to the upper lip of the substantially circular shaped sidewalls of the body 101. The retaining plate may be angled, or beveled, in such a way that the object 200 is retained in a biased position such that it can be easily removed from the container and can be easily viewed. The container may have an attachment device 113 that may be mounted to the body 101. The attachment device 113 may be a clip or it may be a magnet. It should be noted that attachment device 113 is depicted as a clip yet it is envisioned that the attachment device can take the form of any hook and loop, carabineer, magnet, or other arch like shape. The aforementioned elements may be composed of bronze, silver, gold, platinum, or other metallic compositions. The container may also be plated with any unique combination of previously stated or other similar compositions. Additionally, the container may be engraved with writing. In some embodiments, the container may further have symbolic or decorative material affixed to its surface.

Figure 1:
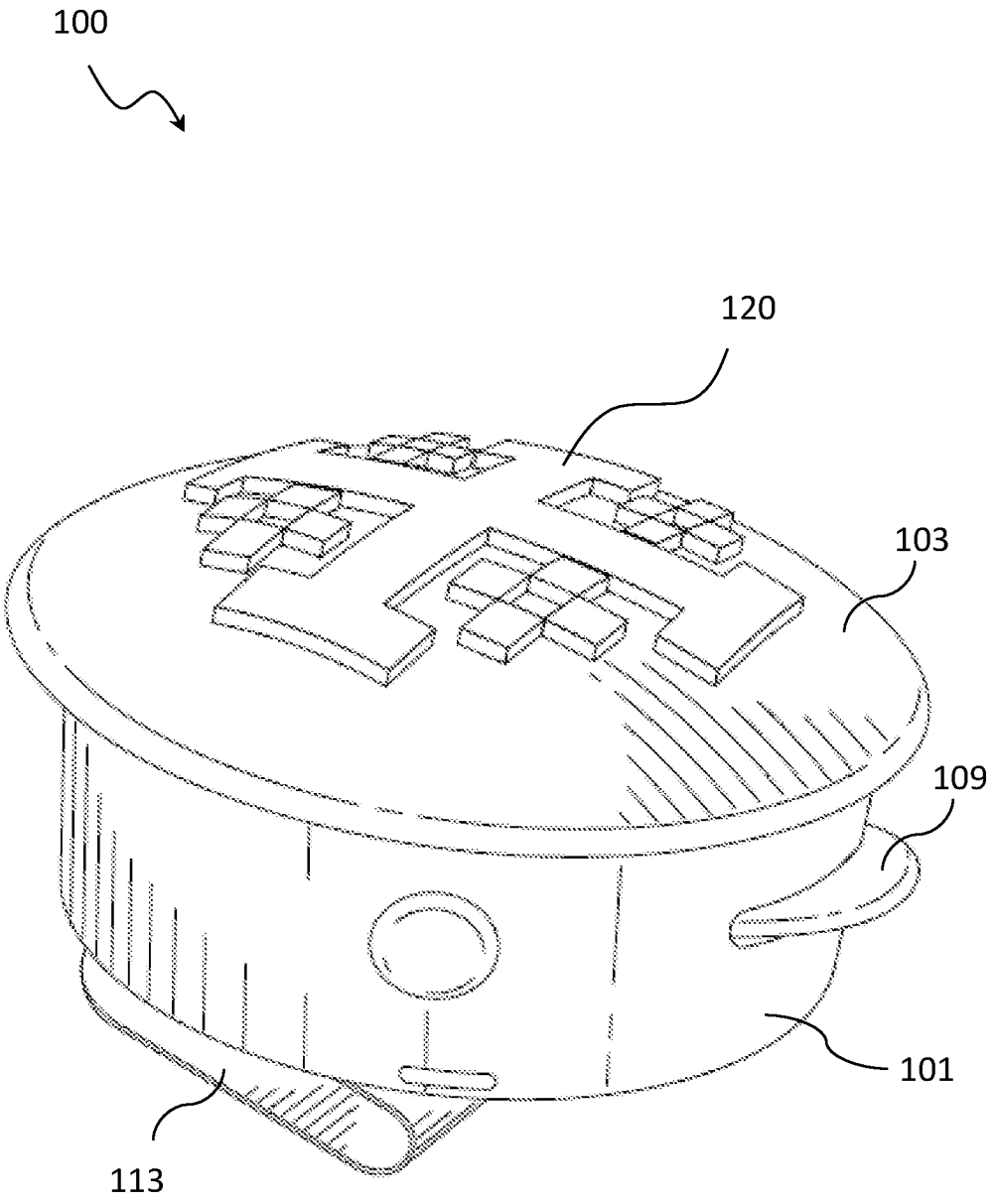

The container may have surface ornamentation 120 as pictured in FIG. 1. The container may have a body 101 attached to the lid 103 by a hinge 105 as depicted in an open position by FIG. 3A. The container may have an attachment device 113 attached to the underside of the exterior of the bottom face of the body 101. The lid 103 may remain in a closed position as illustrated by FIG. 1. The lid 103 may remain retained in a closed position by the closure latch 111 shown in FIG. 3A. The release button 109 may move the closure latch 111 such that it releases from an engaged position with the lid 103. The body may have a spring like mechanism 115 as shown in FIG. 3A that may provide a modest force to object 200. This force may be sufficient to retain the object 200 against the retaining plate 107. The object 200 may be a wafer such as commonly used during Eucharistic Communions. The object 200 may be a substantially gluten free wafer. The object 200 may alternatively be any other object that may require sorting in a compartmented container such as disclosed herein.

Referring generally to FIG. 4 an exemplary embodiment of a container 100 may be disclosed. A retaining plate is not shown in FIG. 4 to more clearly define the interior elements. The container may have a lid 103 attached to the body 101. The body 101 may have a depressible insert or release button 109. The release button 109 may be coupled to a closure latch 111 that may secure to the underside of the lid 103. The lid 103 may further have a catch 103A. The catch 103A may be sized accordingly to properly engage with the closure latch 111. It should be noted that various size catches 103A may be configured to interact with various size closure latches 111 such that they would not deviate from the spirit of this invention. In an alternative embodiment, the lid 103 may be shaped with an indentation such that a catch 103A is not required. The container 100 may have a stopper mechanism 115, which may be a fixed element, a spring or spring-like element, a bent lever arm, or a rigid wire. As illustrated in FIG. 4 the stopper mechanism 115 may provide a biasing element, in the form of a rigid wire or rigid strip, to incline contents, such as a wafer toward an opening or a retaining plate. The retaining plate is not illustrated to further define the stopper mechanism 115, which would be substantially obscured from view if the retaining plate were illustrated. More particularly, the stopper mechanism 115 may include angled feet 117, which may work in conjunction with the remainder of stopper mechanism 115 to retain contents at a desired angle. Angled feet 117 may hold one side of contents against the bottom while, while a raised portion of the stopper mechanism spaces the opposite side of the contents away from the bottom, angling the contents toward an opening formed between the half wall or retaining plate and the sidewall. Angled feet 117 may be formed integrally with stopper mechanism 115 or may optionally be distinct from stopper mechanism 115. Angled feet 117 may help hold a wafer in the bottom of the container. This may help a wafer to be tilted toward the retaining plate 107. Additionally, elements from alternate embodiments may be incorporated or omitted, as desirable. For example, the retaining plate may be any size such that it may adequately provide a rigid retaining plane to act in concert with the stopper mechanism 115. The retaining plate may be similar to FIG. 5 element 107 or it may be similar to element 307 of FIG. 3B. In some alternate embodiments, a stopper mechanism may be a helical spring coupled at an angle to the interior of the bottom side of the body 101 to provide a force in a biased direction toward an opening formed between the retaining plate 107 and the body 101.

The interior arm 112 of FIG. 5 may interact with the release button 109 and closure latch 111 of FIG. 4. FIG. 5 illustrates at least one possible embodiment in which the interior arm 112 may be configured to provide a modest force against the closure latch 111 such that it remains closed. As shown in FIG. 5 in light of FIG. 4 it may be seen that interior arm 112 may be moved away from the closure latch 111 when the release button 109 is activated.

FIG. 6 may show an embodiment of container 100 in a desired orientation for operation, where the attachment device 113 may secure container 100 to an edge of a Eucharistic Bowl, on the pants or shirt pocket of an individual, or any alternate structure that lends itself well to similar uses. In some embodiments, the attachment device 113 may permanently affix container 100 to an object or surface, as would be understood by a person having ordinary skill in the art. In this orientation, lid 103 may be coupled to the body 101 by a hinge 105. The hinge may be disposed toward the lowest portion of the body 101 such that it may be assisted by gravity. In at least some embodiments the assistance of gravity is not necessary as a spring like mechanism or actuated hinges may be used in the alternative. Container 100 may have a retaining plate 107 that is roughly 50% of the surface area of the underside of the lid 103. Stated another way the retaining plate 107 may have a surface area that is roughly 50% of the surface area of the open top of the container body 101. In some alternative embodiments, as shown in exemplary FIG. 3B, the retaining plate 307 may have a smaller surface area, allowing contents to project further from the container. The retaining plate 107 may be any desired size, as would be understood by a person having ordinary skill in the art. FIG. 6 may show an advantageous resting orientation for an object 200 such that it may be easily viewed and removed. In an exemplary embodiment, multiple objects 200 may be stacked on top of one another in the container.

The foregoing description and accompanying figures illustrate the principles, preferred embodiments, and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A container comprising:

a cupped body having a fixed sidewall and bottom wall, and a hinged lid;

a stopper mechanism disposed on an interior surface of the bottom wall;

a retaining plate disposed in an opening of the cupped body;

a closure latch disposed on the lid and a corresponding release button disposed on the sidewall; and an attachment device disposed on an exterior surface of the bottom wall, wherein the stopper mechanism is configured to project outward from the interior surface of the bottom wall in an area not covered by the retaining plate, and wherein the stopper mechanism is configured to angle contents of the container toward an opening created by the sidewall and the retaining plate.

2. The container of claim 1, wherein the stopper mechanism further comprises angled feet.

3. The container of claim 1, wherein the container is made of metal.

4. The container of claim 1, wherein the retaining plate covers approximately 50% or more of the opening in the cupped body.

5. The container of claim 1, wherein the retaining plate covers less than approximately 50% of a total surface area of the opening in the cupped body.

6. A container comprising:

a cupped body having a flat bottom wall and a substantially cylindrical sidewall;

a hinged lid configured to cover an opening of the cupped body;

a closure latch on the lid and a release button disposed in the cupped body, wherein the closure latch and release button act in concert to close and release the hinged lid;

a stopper mechanism disposed on an interior bottom surface of the body and a retaining plate disposed in an open end of the cupped body, wherein the stopper mechanism biases an object against the retaining plate; and an attachment device disposed on an exterior surface of the bottom wall, wherein the stopper mechanism is configured to project outward from the interior surface of the bottom wall in an area not covered by the retaining plate, and wherein the stopper mechanism is configured to angle contents of the container toward an opening created by the side wall and the retaining plate.

7. The container of claim 6, wherein the container is made of metal.

8. The container of claim 6, wherein the retaining plate covers approximately 50% or more of the open end of the cupped body.

9. The container of claim 6, wherein the retaining plate covers less than approximately 50% of a total surface area of the open end of the cupped body.

* * * * *